United States Patent [19]

Taylor

[11] 3,983,976

[45] Oct. 5, 1976

[54] PORTABLE SECRETARY

[75] Inventor: Alan R. Taylor, Decatur, Ga.

[73] Assignee: The Raymond Lee Organization, Inc., New York, N.Y.

[22] Filed: June 9, 1975

[21] Appl. No.: 585,043

[52] U.S. Cl. ..... 190/18 R; 190/42; 220/18

[51] Int. Cl.[2] ..... A45C 13/00

[58] Field of Search ..... 190/11, 42, 18 R; 150/1.6; 220/18; 312/231, 245; 108/152

[56] References Cited

UNITED STATES PATENTS

| | | | |
|---|---|---|---|
| 2,595,752 | 5/1952 | Batts | 220/18 X |
| 2,717,717 | 9/1955 | Busch | 220/18 |
| 3,177,991 | 4/1965 | Walker | 190/42 X |
| 3,189,394 | 6/1965 | Fay | 312/231 |
| 3,286,871 | 11/1966 | Eberline | 220/18 X |

*Primary Examiner*—Donald F. Norton
*Attorney, Agent, or Firm*—Howard I. Podell

[57] ABSTRACT

A portable case and desk fitted with brackets for mounting to a wall. The case is fitted with a flat top panel that is hinged for access to the case interior and serves as a desk top, with one or more trays slidably mounted to extend from one or both sides of the case. A spring clip is fitted to the top panel and a carrying handle is fitted to one side of the device.

1 Claim, 2 Drawing Figures

PORTABLE SECRETARY

SUMMARY OF THE INVENTION

My invention is a portable case and desk fitted with brackets for mounting to a wall. The case is fitted with a flat top panel that is hinged for access to the case interior and serves as a desk top, with one or more trays slidably mounted to extend from one or both sides of the case. A spring clip is fitted to the top panel and a carrying handle is fitted to one side of the device.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
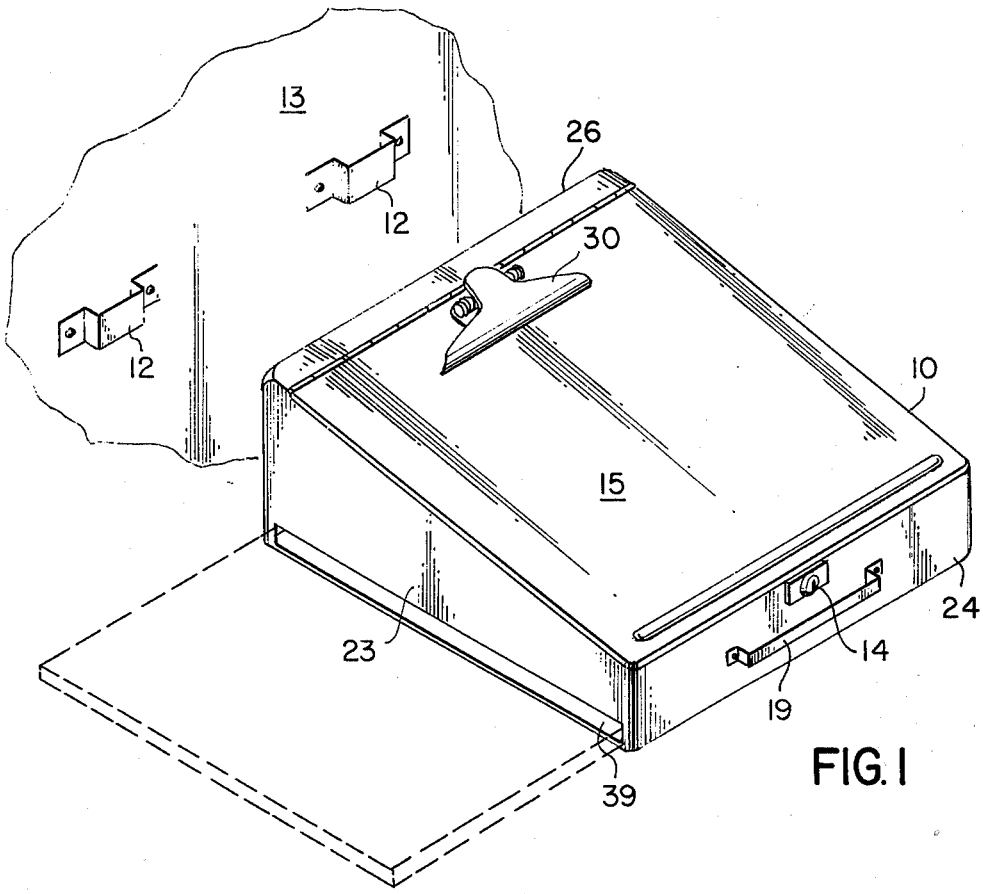
FIG. 1 is a perspective view of the invention.
Figure 2:
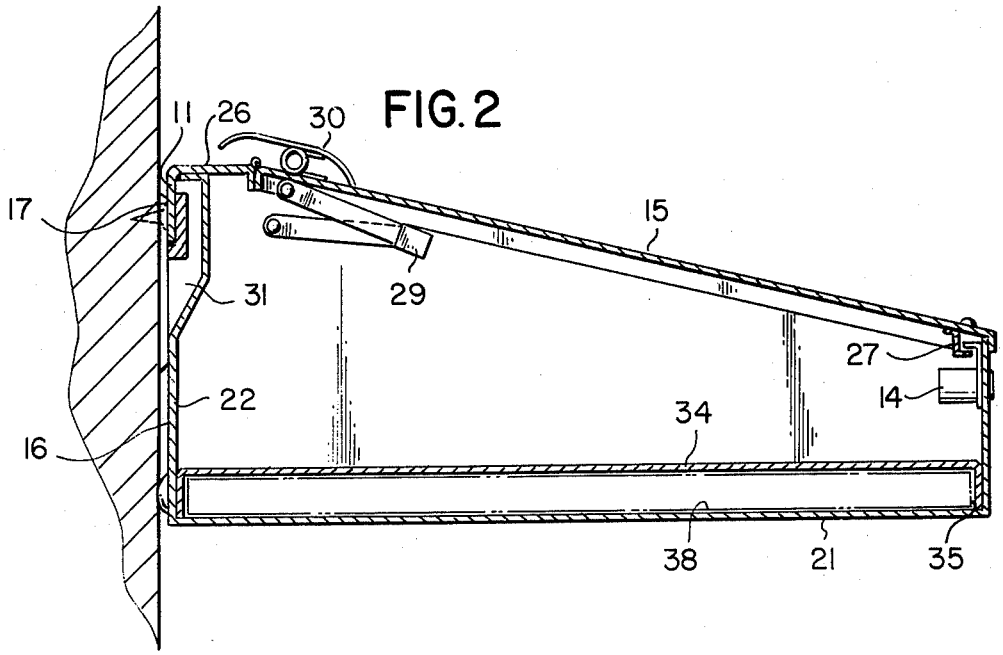
FIG. 2 is a sectional view of the invention.

Turning now descriptively to the drawings, in which similar reference characters denote similar elements throughout the several views, FIGS. 1–2 illustrate the portable secretary case 10 which may be fastened by top hooks 11 to brackets 12 mounted on a wall 13 to extend horizontally from wall 13 with the flat top panel 15 serving as an inclined desk top.

The case 10 is formed with a bottom panel 21, a rear panel 22 two side panels 23, a front panel 24 of shorter height than the rear panel 22, with a bracket 26 extending along the top of rear panel 22 that is hinged to top panel 15. Hinged brackets 29 are mounted to the interior of top panel 15 to maintain the top panel in the open position, when desired.

Rear panel 22 is formed with recessed sections 31 to permit hooks 11 fastened to the rear of bracket 26 to engage wall brackets 12, with wall brackets 12 enclosed in recessed sections 31 so as to enable rear panel 22 to rest adjacent to the wall 13.

A false bottom panel 34 is spaced apart and parallel to bottom panel 21 to provide a recess 35 in which a slidable tray 38 may be mounted. Slidable tray 38 may be slid out of side opening 39 to serve as an auxilliary platform, in the installed position.

A handle 19 is fastened to the exterior of front panel 24 for handling when the unit 10 is detached from a wall and the exterior back surface 17 of hook 11 lies parallel to the exterior surface 16 of rear panel 22 to permit resting rear panel 22 of the case 10 on a level horizontal surface in the upright position.

A lock 14 is fitted in front panel 24 to engage a flange 27 on the underside of top panel 15 in the locked position.

A spring clip 30 is mounted on the upper portion of the top panel 15 for securing of papers to the panel 15.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A combination portable carrying case and desk attachable to a wall comprising a case in the form of a hollow chamber enclosed by a base panel fitted to a rear panel and to side panels, said case fitted with a hinged top panel, with a fitting mounted on a rear panel of the case adaptable for positive removable attachment to a mating bracket mounted on a wall, and with a handle mounted on a front panel, in which the fitting of the rear panel extends in the general plane of the said rear panel, with said rear panel formed with a recess of a shape to enclose the said mating bracket on a wall to which said fitting is attached, so that the said rear panel may rest flush against the said wall in the attached condition, said top panel mounted by hinges to the case so as to rotate about a horizontal axis parallel to the general plane of the rear panel in the said attached condition, said hinges spaced on the case a distance from the said rear panel, said top panel fitted with latching means to retain the top panel in closed position in which said top panel is oriented in a plane that extends at an acute angle to the plane of the base panel.

* * * * *